United States Patent [19]

Dennison

[11] 4,369,016

[45] Jan. 18, 1983

[54] TURBINE INTERMEDIATE CASE

[75] Inventor: William T. Dennison, East Hartford, Conn.

[73] Assignee: United Technologies Corporation, Hartford, Conn.

[21] Appl. No.: 106,417

[22] Filed: Dec. 21, 1979

[51] Int. Cl.[3] ..... F01D 25/16

[52] U.S. Cl. ..... 415/142; 415/175; 415/180; 415/68

[58] Field of Search ..... 415/180, 175, 142, 66, 415/68, 69; 60/39.16 R, 39.32, 39.08

[56] References Cited

U.S. PATENT DOCUMENTS

| | | | |
|---|---|---|---|
| 2,710,523 | 6/1955 | Purvis | 60/39.32 |
| 2,869,941 | 1/1959 | Shoup et al. | 415/142 |
| 2,933,893 | 4/1960 | Blyth et al. | 60/39.16 R |
| 3,057,154 | 10/1962 | Sherlaw et al. | 415/180 |
| 3,057,542 | 10/1962 | Keenan et al. | 415/180 |
| 3,084,849 | 4/1963 | Dennison | 415/175 |
| 3,250,512 | 5/1966 | Petrie | 415/69 |
| 3,382,670 | 5/1968 | Venable | 60/39.16 R |
| 3,453,825 | 7/1969 | May et al. | 60/39.16 R |
| 3,704,075 | 11/1972 | Karstensen | 415/68 |

*Primary Examiner*—Robert E. Garrett

*Attorney, Agent, or Firm*—Charles A. Warren

[57] ABSTRACT

A turbine intermediate case in which the outer case element carries a series of inwardly extending struts that position the bearing support centrally within the outer case element and these struts support the inner case element within and in spaced relation to the outer case element. The inner case element carries seals at opposite ends, a diaphragm and a support ring for the row of turbine vanes downstream of the case. The struts provide a vent for the air cavity formed by the diaphragm and carry a baffle to control heat transfer between strut and vent air.

12 Claims, 3 Drawing Figures

TURBINE INTERMEDIATE CASE

BACKGROUND OF THE INVENTION

In a turbine installation which has a gas turbine engine acting as a generator for hot gas to power a free turbine, the turbine intermediate case is located downstream of the gas generator turbine stages and between them and the free or power turbine. This case provides a bearing support for the rear bearing of the low pressure turbine shaft and the front bearing for the free turbine. This case is subjected to severe thermal gradients during both transient conditions and steady state operation and requires controlled cooling in order to maintain concentricity both under steady state conditions and under transient conditions. This cooling is particularly necessary in order to provide the long life required in turbine installations, for example in commercial electrical generating systems.

SUMMARY OF THE INVENTION

A feature of the invention is the support of a bearing structure from the relatively heavy outer turbine case element and the support of the inner relatively thin inner case element by the same struts that carry the bearing support. Another feature is the support of seals from the inner case and also the positioning of the inner vane ring for the free turbine on the inner case element. Another feature is the creation of a vent cavity within the inner case element. One feature of the invention is the thermal protection of both inner and outer case elements by heat shields and the manner of supporting these shields. Another feature is the thermal protection of the struts and the positioning of the insulating bearing so as to minimize thermal stresses.

According to the invention the relatively heavy outer turbine case element has radially extending hollow struts that are welded at their inner end to the bearing support structure and the inner case is welded to the struts. The inner case element carries seals upstream and downstream of the bearings to define a vent cavity. A baffle is positioned within the strut for thermal protection. The gas path is spaced from the inner and outer case elements by heat shields or panels spaced from the case elements and supported from the case elements with insulating material between the shields and the case elements. A fairing surrounding and spaced from the struts permits thermal expansion of the several parts with a minimum of thermal stress and the shields are so mounted and constructed as to provide a minimum of thermal stress with a minimum of gas leakage past the shields.

The foregoing and other objects, features and advantages of the present invention will become more apparent in the light of the following detailed description of preferred embodiments thereof.

DESCRIPTION OF THE PREFERRED EMBODIMENT

Figure 1:
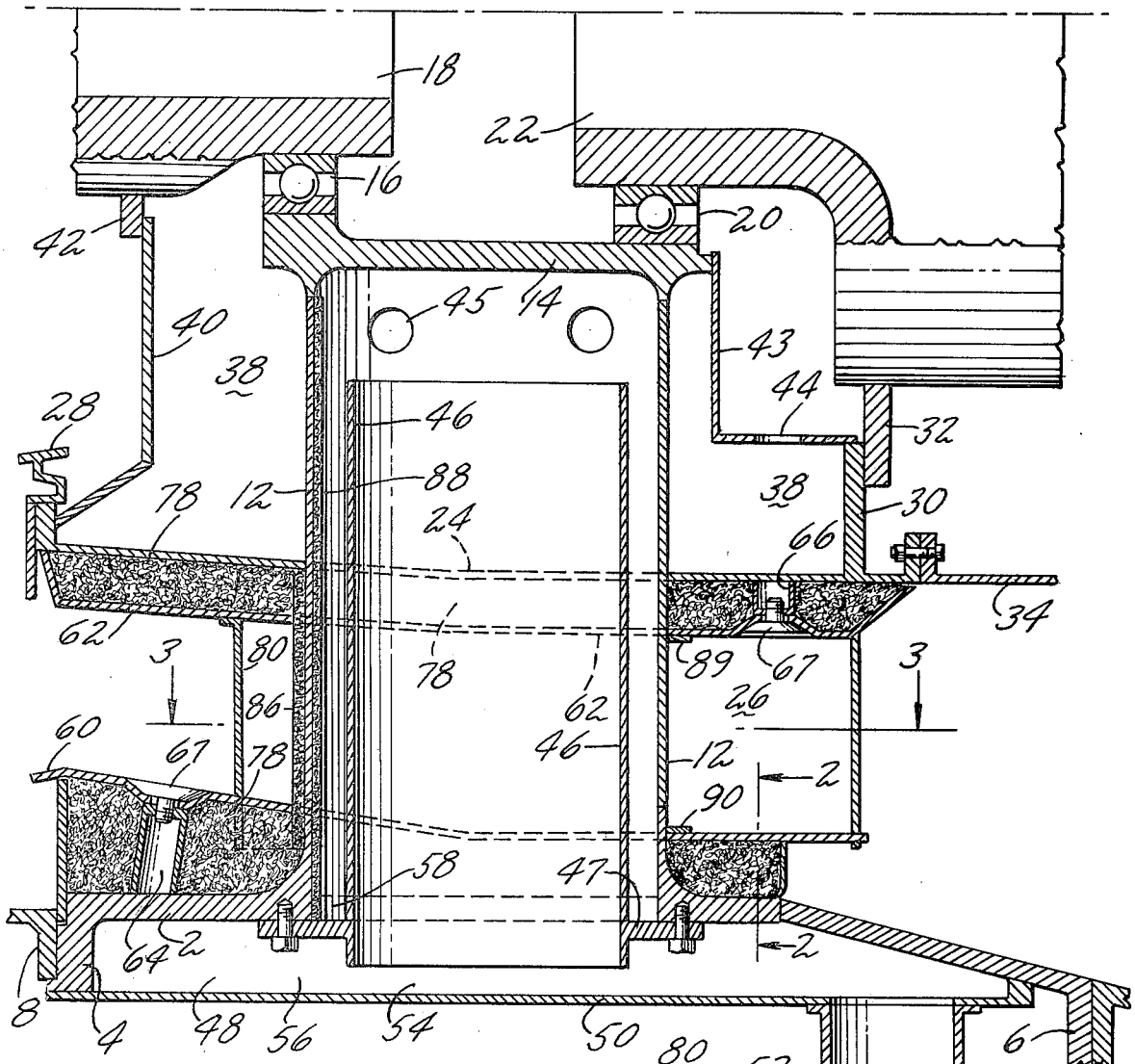
FIG. 1 is a sectional view through the turbine case.

Referring to FIG. 1 the invention is shown in a turbine intermediate case positioned between the last stage of the turbine forming a part of a gas generator and the first stage of the free or power turbine driven by gas under pressure from the gas generator. Such free turbine power plants are well known; they have many uses one in particular being the use of the free turbine to drive an electrical power generator. In such an installation the power plant is expected to be brought into operation in a very short time resulting in severe thermal gradients and when started to operate at a steady state for a long period of time resulting in long term thermal stresses that are desirably minimized to permit high performance of a power plant over long periods with a minimum of overhaul or repair.

As shown the outer case element 2 is relatively heavy and has mounting flanges 4 and 6 at opposite ends for attachment to the turbine case 8 of the gas generator and the turbine case 10 of the free turbine. A plurality of radial struts 12 extend inwardly from the outer case to support the bearing structure 14. The struts are preferably welded to both the outer case element and the bearing support structure. As shown bearing 16 in the bearing structure 14 supports the turbine shaft 18 of the gas generator and bearing 20 supports the free turbine shaft 22.

The struts 12 also support an inner case element or ring 24 concentric to and spaced inwardly from the outer case element or ring to define a space for a gas path 26 therebetween. The inner case element is relatively thin and is desirably welded to the struts. This inner case element supports at its upstream end a seal 28 positioned at the downstream side of the last turbine stage of the gas generator. At its downstream end the inner case element has a flange 30 carrying a seal 32 for the front of the free turbine. The inner case element also has attached thereto a vane ring 34 for the inner ends of the row of vanes of the first free turbine stage. This ring is preferably bolted to the inner case as shown.

A vent cavity 38 surrounding the inner end of the struts and extending around the bearing support is formed at its downstream side by the flange 30 and seal 32. The upstream wall is a diaphragm or baffle 40 extending from the inner case at a point adjacent the seal 28 inwardly to the turbine shaft 18, the inner edge of the baffle 40 carrying a seal 42 engaging the shaft. A baffle 43 extends from the flange 30 to the bearing support adjacent to the bearing 20 to shield the bearing from relatively hot air leaking by the seal 32. Openings 44 is this baffle permit a flow of vent air past the baffle.

The vent cavity communicates with the hollow struts through openings 45 in the struts and air entering these holes flows outwardly in the struts being guided by a baffle or sleeve 46 in each strut, spaced from the strut itself as shown and supported by flanges 47 on the sleeves bolted to the outer case element. The outer ends of these sleeves are open to a chamber 48 surrounding the outer case element, the outer wall of the chamber being formed by panel segments forming a sleeve 50 secured at opposite ends to the outer case. This sleeve 50 has a vent port 52.

To minimize heating of the inner and outer case elements, the gas path between these cases is defined by outer and inner annular shields 60 and 62 located between and spaced from the outer and inner case elements respectively. The outer shield is supported by angularly spaced stanchions 64 extending inwardly from the outer case element and the inner shield is supported by similar stanchions 66 extending outwardly from the inner case element. Bolts 67 hold the baffles in position as shown.

Figure 2:
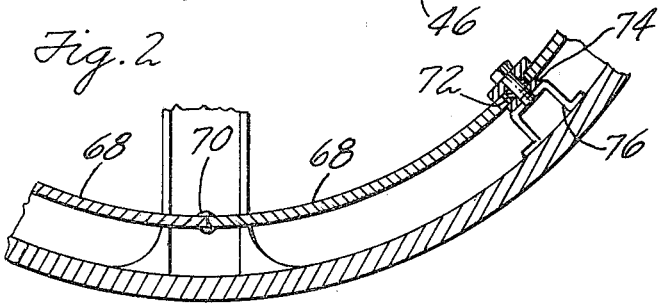
FIG. 2 is a sectional view along the line 2—2 of FIG. 1.

Both inner and outer shields are made in segments 68 and the segments are welded in pairs at 70 at the point where they surround the struts as shown in FIG. 2. Midway between the struts the segments have a circumferential gap 72 to accommodate thermal growth. This gap is sealed by supporting the panels or segments on a longitudinal strip 74 which is supported by stanchions 76 from the case. The spaces between the outer shield and the outer case and between the inner shield and the inner case are filled with insulation 78 as shown.

Figure 3:
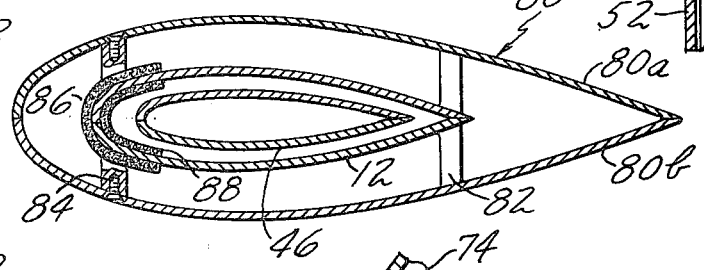
FIG. 3 is a sectional view along the line 3—3 of FIG. 1.

The struts are protected by fairings 80 surrounding the struts in spaced relation. Each fairing is made up of two halves 80*a* and 80*b* mechanically attached to the struts as by bosses 82 on the struts, FIG. 3, and screws 84 extending through the fairing. Prior to positioning the fairings the leading edge of the strut at least and preferably the entire strut has insulation 86 thereon for thermal protection of the strut. The inner surface of the strut may also have insulation 88 thereon.

Where the struts extend through the inner shields 62, split collars 89 extend around the struts and are welded to both strut and segments of the baffle to seal the flow path at this point. Collars 90 at the outer shields 62 are welded only to the baffle segments to permit sliding movement between the baffle and the strut for radial thermal expansion.

The effect of the structure above described is to minimize thermal effects during transient conditions which would otherwise be severe because of the short startup time or which would exceed the temperature limit of the case material. The structure also provides for avoiding excessive thermal changes during steady state operation by the heat shield, baffles, cooling structure and insulation. In this way with a minimum of thermal stresses the structure is capable of very long term operation since thermal stresses are either avoided or reduced to a minimum whenever the power plant is in operation.

Although the invention has been shown and described with respect to a preferred embodiment thereof, it should be understood by those skilled in the art that other various changes and omissions in the form and detail thereof may be made therein without departing from the spirit and the scope of the invention.

Having thus described a typical embodiment of my invention, that which I claim as new and desire to secure by Letters Patent of the United States is:

1. A turbine bearing support including:

an outer case element;

an inner case element within and spaced from the outer case element;

a plurality of hollow struts extending radially inward from the outer case element and through the inner case element and secured to both;

a bearing support secured directly to and supported by the inner ends of the struts;

seals carried by said inner case element adjacent opposite ends; and a turbine vane ring removably attached to the downstream end of the inner case element.

2. A turbine bearing support as in claim 1 in which the support is between a gas generator and a free turbine and the vane ring supports the first stage vanes for the free turbine.

3. A turbine bearing support as in claim 1 in which one bearing in the support carries a free turbine shaft and the vane ring supports the first stage vanes of the free turbine.

4. A turbine bearing support as in claim 1 in which baffles positioned between the inner and outer case elements and mounted on said elements define a gas path therebetween and these baffles retain insulation between them and the case elements.

5. A turbine bearing support as in claim 4 in which the baffles are in segments and are constructed to permit circumferential expansion between the segments.

6. A turbine bearing support as in claim 5 in which a fairing surrounds each strut in spaced relation thereto, the fairing extending between the baffles and across the gas path.

7. A turbine bearing support located between the downstream end of a gas generator and a free turbine, said support including:

an outer case element;

a plurality of radial struts secured to and extending inwardly from the case element;

a bearing support secured directly to and carried by the inner ends of the struts;

an inner case element within and spaced from the outer case element and through which the struts extend and to which it is secured, said inner case element having at least one seal supported from one end of the case;

a diaphragm carried by said inner case adjacent the upstream end, said diaphragm defining a vent cavity between it and the struts and a seal at the inner edge of the diaphragm.

8. A turbine bearing support as in claim 7 in which the struts have vent holes communicating with the vent cavity and for the flow of air from the cavity through the struts.

9. A turbine bearing support as in claim 7 including inner and outer baffles positioned between inner and outer case elements and defining a gas path therebetween, the baffles being supported by the case elements and being segmented to allow thermal expansion.

10. A turbine bearing support as in claim 9 in which insulation is positioned between the baffles and the adjacent case elements.

11. A turbine bearing support as in claim 10 including fairings around the struts between the inner and outer baffles.

12. A turbine bearing support as in claim 7 including a baffle extending within and in spaced relation to the struts.

* * * * *